United States Patent [19]

Rose

[11] Patent Number: 4,640,180

[45] Date of Patent: Feb. 3, 1987

[54] GUN-FIRING SYSTEM

[75] Inventor: Millard F. Rose, King George, Va.

[73] Assignee: The United States of America as represented by the Secretary of the Navy, Washington, D.C.

[21] Appl. No.: 746,824

[22] Filed: Jun. 20, 1985

[51] Int. Cl.[4] ..... F41F 1/00; F42B 5/00

[52] U.S. Cl. ..... 89/8; 102/430

[58] Field of Search ..... 89/8, 7, 28.05; 102/430, 202, 291, 472; 376/144, 145, 107, 150; 124/3; 313/231.31, 231.41, 231.51; 315/111.21-111.81; 219/121 P, 121 PM; 60/202, 203.1

[56] References Cited

U.S. PATENT DOCUMENTS

| | | | |
|---|---|---|---|
| 3,052,088 | 9/1962 | Davis et al. | 60/202 |
| 3,418,206 | 12/1968 | Hall et al. | 376/107 X |
| 3,431,816 | 3/1969 | Dale | 89/8 |
| 3,613,499 | 10/1971 | Hubbard et al. | 89/8 |
| 3,809,964 | 5/1974 | Ceyrat | 89/28.05 X |
| 3,854,097 | 12/1974 | Fletcher et al. | 89/8 X |
| 3,916,761 | 11/1975 | Fletcher et al. | 89/8 |
| 3,929,119 | 12/1975 | Fletcher et al. | 89/8 X |
| 3,939,816 | 2/1976 | Espy | 89/8 X |
| 4,429,612 | 2/1984 | Tidman et al. | 89/8 |
| 4,534,263 | 8/1985 | Heyne et al. | 89/8 |
| 4,590,842 | 5/1986 | Goldstein et al. | 89/8 |

*Primary Examiner*—Deborah L. Kyle
*Assistant Examiner*—John E. Griffith
*Attorney, Agent, or Firm*—Elmer E. Goshorn; Thomas E. McDonnell

[57] ABSTRACT

Improved gun-firing system for electrically augmenting the energy released by ignited propellant of the system so as to increase the velocity of the projectile as it launches from the system thereby increasing the probability that it will strike a fast-moving target. The system is generally made up of a barrel and a breech. The breech is provided with a firing chamber for receiving a projectile and an ignitable propellant. In one embodiment, the breech of the system is generally comprised of a detonator, a pair of relatively spaced pressure-responsive switches and a helically wound electromagnetic coil. A power supply is connected by an interlock to the switches and coil such that the coil is not energized until both switches close. These switches close in response to the pressure of the plasma that has been progressively formed from igniting the propellant in the breech chamber. Upon coil energization, eddy currents are induced in the plasma so as to cause further heating and pressurizing of the plasma and resulting in the projectile exiting from the barrel at a greater velocity. In another embodiment, a pair of opposed and relatively spaced electrodes of different and special construction are mounted in the breech and in relation to the chamber. Upon ignition of the propellant by the detonator in the chamber, plasma is formed therein thereby creating a sustained and expanding arc discharge between the electrodes. The arc discharge augments the plasma by ohmically heating and further pressurizing same within the chamber in the projectile velocity.

15 Claims, 7 Drawing Figures

GUN-FIRING SYSTEM

This invention relates to a gun-firing system for launching a projectile and more particularly it relates to an improved gun firing system for electrically augmenting the plasma generated by an ignited chemical propellant so as to increase the velocity of the projectile as it exits from the system.

BACKGROUND OF THE INVENTION

Various designs and techniques have been developed in the past for accelerating and launching a projectile. For example, U.S. Pat. No. 3,431,816 to Dale concerns an electric augmented gun-firing system. The system is generally made up of a barrel and a breech block. A power supply is generally made up of a first pair of arc-discharge electrodes and a second pair of inductor-operated arc-discharge electrodes. The electrodes are operatively associated with the breech and barrel of the system such that upon filling the firing chamber with a pressurized and ignitable gaseous medium and then operating the power supply, a portion of the gas is ionized and continuously sustained so as to form a longitudinally advancing and pressurized wave front that causes acceleration and launching of a projectile from the barrel. U.S. Pat. No. 3,613,499 to Hubbard et al. concerns a projectile acceleration system. The system is generally comprised of a barrel. The barrel at least at one preselected point includes a capacitance augmenting station. The station is generally made up of a pair of diametrically opposed electrodes and a gas-rupturable diaphragm seal associated with each electrode. A projectile is initially accelerated in some fashion by a pressurized and ionized gas. As the projectile advances past a station in the barrel bore, the pressurized gas ruptures the diaphragms thereby enabling an arc to be discharged between the electrodes for further energizing the gas and thus cause continued and increased acceleration of the projectile. U.S. Pat. No. 3,916,761 to Fletcher discloses a meteroid simulation apparatus. The apparatus generally comprises a combined initial projectile-acceleration barrel arrangement and a subsequent plasma-generator, projectile-acceleration device. The barrel arrangement includes a powder cartridge for compressing inert gas to initially accelerate a projectile. The plasma device is provided with a pair of electrodes for timely transforming a metal foil into a plasma and then further energizing and densifying the plasma by an electromagnetic coil so as to finally accelerate the gas-fired projectile to a hypervelocity for simulating a meteroid. U.S. Pat. No. 4,429,612 to Tidman et al. concerns a multistation electrode apparatus within a controlled and ionizable gaseous medium for accelerating a projectile of special-shaped, conical-like configuration. However, none of the aforediscussed references, whether taken alone or in any combination, remotely suggest an improved gun-firing system which is provided with a chamber for receiving propellant and a projectile, and which is also provided with helically wound electromagnetic coil about and along the chamber for inducing heating of the plasma of the ignited propellant in the chamber so as to further pressurize same for causing launching of the projectile at a higher velocity from the gun. In another embodiment, the breech of the system is provided with a pair of electrodes of special and different construction for generating a sustained and expanding arc across the chamber between its ends so as to further heat and pressurize the plasma in order to increase the velocity of the projectile as it exits from the gun.

SUMMARY OF THE INVENTION

An object of the invention is to provide an improved gun-firing system that will require minimal skill of field personnel in launching a projectile at greater velocity from a gun barrel where the projectile has been accelerated by an electrically-augmented propellant.

Another object of the invention is to provide an improved gun-firing system where an existing gun system can readily be modified without materially increasing the operational requirements of the gun-firing system while at the same time significantly increasing the velocity of the projectile as it is launched from the system.

Still another object of the invention is to provide an improved gun-firing system having an adjustable power supply for controlling the increased velocity of a projectile as it exits from the gun system.

Yet another object of the invention is to provide an improved gun-firing system where the breech of the system can readily be insulated and reinforced to withstand the increased pressures exerted by the propellant after being ignited and electrically augmented by the improved system.

In summary, the improved gun-firing system is generally comprised of a barrel and a breech. The breech is provided with inner and outer sleeves of different materials having appropriate electric non-conducting and insulation characteristics. The outer end of the breech is closed-off by a removable cap that enables loading of the breech inner sleeve chamber with a projectile and an ignitable chemical propellant during system use. A detonator is connected to the cap. A pair of relatively spaced pressure-responsive switches are mounted on the breech and are arranged in operative relation to the chamber. An electromagnetic coil is mounted in the breech inner sleeve and is interposed between the pair of switches as well as being helically wound about the inner sleeve between its ends so as to substantially envelope the chamber. A power supply is provided with a manual switch for connecting the detonator, coil and switches. Upon actuation of the detonator by the power supply the propellant is ignited and progressively transformed into a plasma between the ends of the chamber. At the same time, the pair of switches are actuated in response to the pressure created by the plasma so as to connect the coil, by way of an interlock, to the power supply. Upon energization of the coil, the magnetic field in passing through the chamber and the plasma induces eddy currents therein so as to increase the temperature and pressure of the plasma. As the result of the increased pressure, the projectile is accelerated and launched from the barrel at a greater velocity than would be the case where the plasma was not augmented by an electromagnetic field. The power supply includes a potentiometer or the like for controlling the strength of the magnetic field generated by the coil and thus the magnitude of the projectile exit velocity.

In another embodiment of the gun-firing system of the invention, the breech inner sleeve is provided with a pair of relatively spaced electrodes of different construction. One of the electrodes of plug-type configuration is mounted at the outer end of the inner sleeve. The other electrode of elongated strip-like configuration substantially extends between the ends of the chamber and is preferably mounted in diametrically opposed and spaced relation to the other electrode. A detonator substantially extends throughout the length of the chamber so that upon actuation of the detonator, the propellant is ignited at the projectile end of the chamber and is progressively transformed into a plasma that increases in volume from the projectile end of the chamber towards its outer end until the plasma fully occupies the chamber volume. As the result of the plasma progressively forming from the chamber projectile end to its outer end, a sustained and expanding electric arc is formed between the electrodes that continuously extends toward the chamber outer end. This sustained and expanding arc in the chamber induces ohmic heating of the plasma therein thereby further pressurizing same. Such further pressurization of the plasma causes the projectile velocity to be greater than would be the case without the plasma being subjected to an arc discharge. As with the first embodiment, the power supply is provided with a potentiometer for controlling the potential between the electrodes, and thus the velocity of the projectile itself.

By virtue of the detonator extending into the chamber and by virtue of the pair of electrodes being of particular construction, it is advantageous that the inner sleeve be of removable construction such that the inner sleeve functions as an expendable cartridge which is filled with propellant and closed at its outer end by a projectile, all of which contributes to the easy loading and unloading of the gun system during field use. Because of the cartridge construction of the inner sleeve, the removable cap and closed outer end of the inner sleeve are provided with interconnectable terminal means for facilitating electric connection during system use between the detonator and the power supply and between the strip electrode and the power supply.

By reason of the breech being of insulated construction heat loss is minimized as the plasma is augmented by either the coil or electrode embodiment of the invention as aforediscussed. Also, even though the augmented plasma volume expands somewhat as the projectile is accelerated along the barrel prior to launch therefrom, the insulated breech structure assures that maximum and desired increased velocity of the projectile is attained so as to assure greater probability of striking a fast-moving target. Depending on the forces acting on the breech when the plasma is augmented by operation of the power supply, etc., the breech may require a third or outermost sleeve for reinforcing purposes.

Other objects and advantages of the invention will become apparent when taken in conjunction with the accompanying specification and drawings as follows.

DETAILED DESCRIPTION OF THE INVENTION

Figure 1:
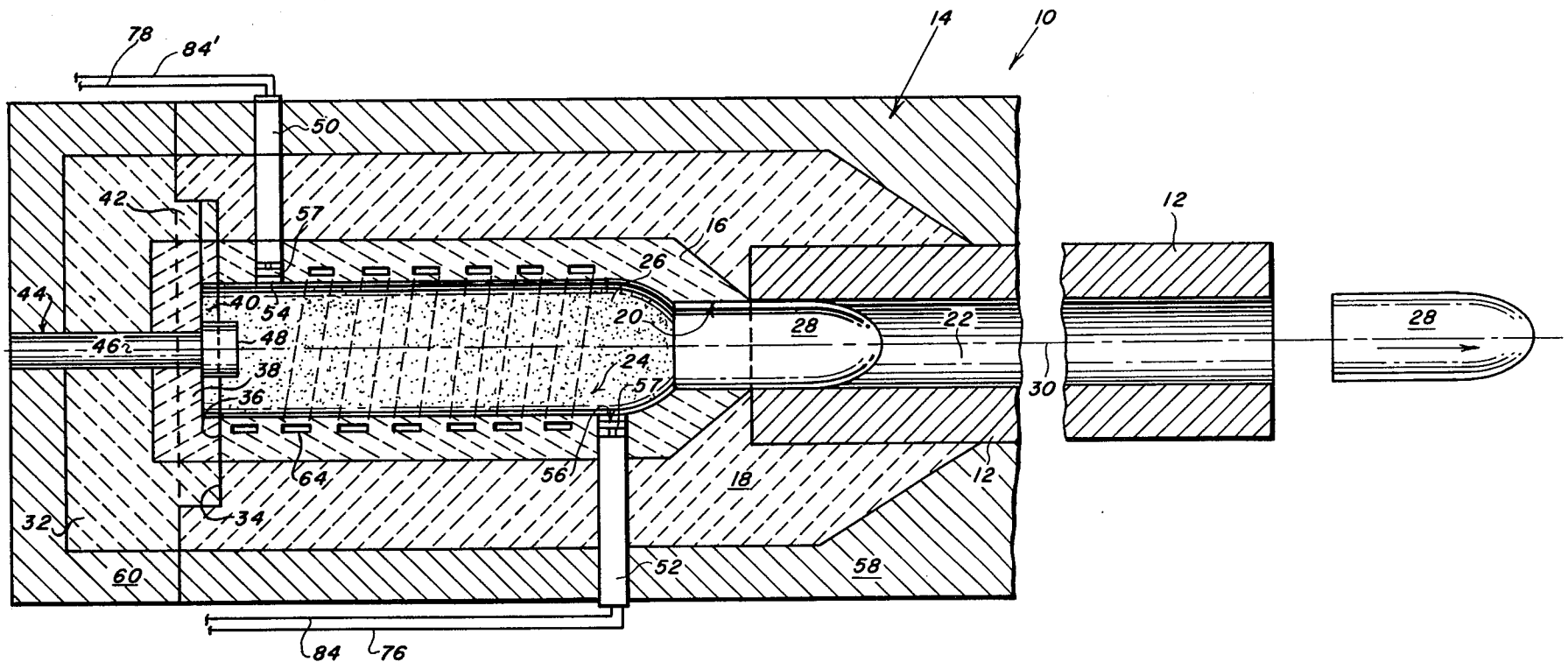
FIG. 1 is a cross-sectional view of a gun-firing system with parts removed and other parts broken away and illustrates an embodiment of the invention.

With reference to FIG. 1, a gun-firing system 10 is generally comprised of a barrel 12 and a breech 14. The breech is made up of inner and outer sleeves 16 and 18. The inner end of sleeve 16 is of frusto-conical shape and surrounds a concentric opening 20 that constitutes an inner uninterrupted extension of barrel bore 22. Sleeve 16 between its ends surrounds a chamber of substantially cylindrical shape that is of larger diameter than opening 20. During use of system 10, chamber 24 receives an ignitable chemical propellant 26 which is made up of a suitable admixture of appropriate chemical materials. Prior to the chamber being filled with propellant through the open outer end of sleeve 16, a projectile 28 is inserted through the chamber and mounted at the inner end of barrel bore 22 in the manner shown in FIG. 1. The inner end of outer sleeve 18 is of frusto-conical shape such that it surrounds and encloses the inner end of barrel 12 while at the same time surrounding and enclosing the inner end of sleeve 16. By reason of outer sleeve surrounding sleeve 16 and the inner end of barrel 12, sleeve 16 and barrel 12 are maintained in concentric relation about and coaxial alignment along system common axis 30 as shown in FIG. 1.

The outer ends of both sleeves 16 and 18 are covered by a removable cover or cap 32. The outer end of sleeve 18 is counterbored so that inner radial surface 34 of sleeve 18 is radially aligned with radial end face 36 at the outer end of sleeve 16. Cap 32 is of cylindrical shape and its inner end is counterbored to receive a circular disc-shaped insert 38. The outside diameter of the insert substantially corresponds to the outside diameter of sleeve 16. The inner or chamber-facing end of insert 38 is counterbored so that the internal diameter of counterbore 40 substantially corresponds to the internal diameter of sleeve 16. Further, counterbore 40 is in direct open communication with chamber 24. Inner reduced end 42 of cap 32 has a diameter substantially corresponding to the diameter of the counterbore at the outer end of outer sleeve 18. At the same time, cap reduced end 42 has a length substantially corresponding to the depth of the outer sleeve counterbore. Since reduced end 42 is concentric about the axis of cap 32, the cap is concentrically and coaxially aligned about system axis 30 when the cap is connected to both sleeves 16 and 18 so as to close off the outer end of chamber 24 as depicted in FIG. 1. For the sake of brevity, a locking device is not shown for securing cap to sleeves 16 and 18 but it is to be understood that any suitable breech locking device can be used.

Inner and outer sleeves 16 and 18 are made up of similar electric non-conducting and thermally insulative materials. Cap insert 38 is preferably made up of a material substantially corresponding to sleeve 16. Similarly, the outer portion of cap 32 is made of a material substantially similar to that of sleeve 18.

A detonator 44 is affixed to cap 32. To this end, a longitudinal concentric opening is formed in cap 32 such that reduced portion 46 of detonator 44 extends through this opening. Enlarged portion 48 of detonator 44 is disposed adjacent cap insert 38 at the outer end of chamber 24. Portion 48 is provided with suitable means for igniting propellant 26 during system use, such as, e.g., an electric resistance heating element (not shown).

A pair of relatively-spaced pressure responsive, and normally-open electric switches 50 and 52 are mounted in sleeves 16 and 18 and disposed in operative relation to chamber 24. To this end, a pair of relatively spaced radial bores 54 and 56 are formed at opposite ends of chamber 24 and fully extend radially through sleeves 16 and 18. These bores are formed such that they are arranged in diametrically opposed and longitudinal offset relation to each other as depicted in FIG. 1. The inner end of each switch 50 or 52 is provided with a spring-biased movable plunger 57. Upon movement of the plunger in both switches 50 and 52, as the result of the pressure exerted by the plasma in chamber 24 after ignition of propellant 26 during system use as will be more fully explained hereinafter, switches 50 and 52 are closed.

It is noted here that depending on the forces generated by ignited propellant 26 and exerted on breech 14 during system use that a reinforcing sleeve 58 may be required. Accordingly, outermost sleeve 58 surrounds sleeve 18 and provides radial openings for receiving the outer ends of switches 50 and 52 as illustrated in FIG. 1. At the same time, cap 32 is provided with an outermost reinforcing section 60 of cap-shaped configuration that aligns with sleeve 58 when the cap is connected to sleeves 16 and 18 as aforedescribed.

Figure 2:
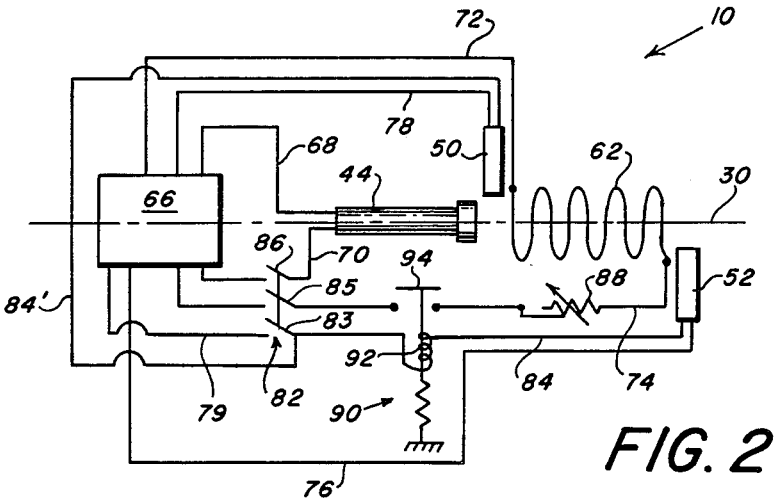
FIG. 2 is a reduced diagrammatic view of the system of FIG. 1 with parts added and illustrates further details of the invention.

An electromagnetic coil 62 is interposed between the pair of switches 50 and 52 and is helically wound about, along and within sleeve 16 in concentric relation to system axis 30 so that when coil 62 is energized, it generates a field which substantially envelopes chamber 26 between the pair of switches 50 and 52 as best depicted in FIGS. 1 and 2. To facilitate the helical winding of coil 62 in sleeve 16, the coil is held in some fashion so as to have a uniform helical extent in concentric relation about an axis while the material of sleeve 16 is formed in an appropriate manner about the helically held coil. Hence, the sleeve after being formed is provided with an uninterrupted helical opening 64 between its ends for receiving coil 62 as partially shown in FIG. 1.

A suitable electric power supply 66 is advantageously connected to detonator 44, pair of switches 50 and 52 and coil 62 as best shown in FIG. 2. A pair of leads 68 and 70 electrically connect detonator 44 to power supply 66. A pair of leads 72 and 74 electrically connect coil 62 to the power supply. Leads 76 and 78 connect switches 50 and 52 directly with the power supply. A lead 79 is connected to power supply 66 and to one terminal of bridge-contact 83 of a normally-open, three-bridge contact, manually-operated switch 82. A lead 84 connects switch 52 to another terminal of bridge contact 83 of switch 82. Lead 84' is connected to lead 84 and switch 50. Separate portions of lead 74 are connected to opposed terminals associated with another bridge contact 85 of switch 82. Similarly, separate portions of lead 70 are connected to opposed terminals of a third bridge contact 86 of switch 82. An adjustable potentiometer 88 is series connected to lead 74. A normally-open single-contact solenoid switch 90 has its solenoid 92 series connected to lead 84. When solenoid 92 is energized, contact 94 of switch 90 bridges its associated terminals that are connected to lead 74 as will be more fully set forth in an operative embodiment of the invention as will now be described.

With cap 32 removed from sleeves 16 and 18 of system 10, a projectile 28 can be inserted in chamber 24 and positioned at the inner end of bore 22 as depicted in FIG. 1. After positioning the projectile, a predetermined amount of propellant 26 is added to chamber 24 to substantially fill same. Upon reconnecting cap 32 to cover the outer ends of sleeves 16 and 18, the propellant is sealed in chamber 24 and ready to be ignited. In reconnecting cap 32, enlarged inner portion 48 of detonator 44 will disperse some of the propellant. However, the counterbore 40 of cap will readily accommodate this dispersion assuring that cap 32 can be readily connected and locked to sleeves 16 and 18.

Figure 3:
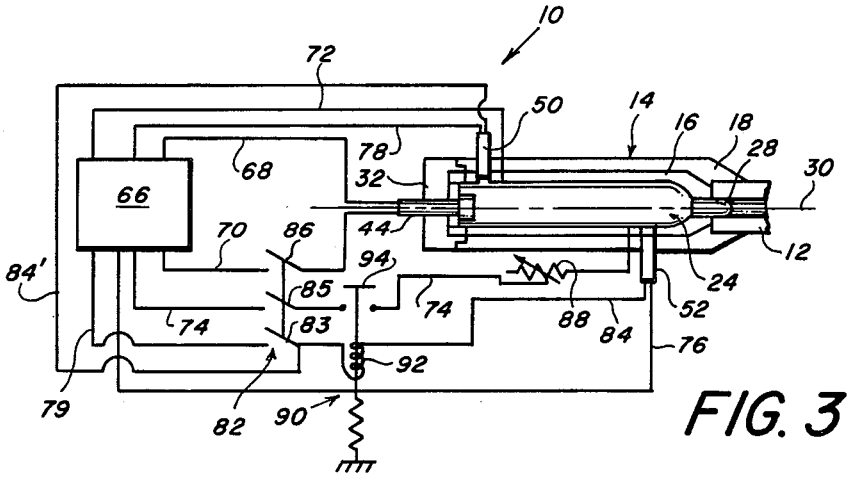
FIG. 3 is a diagrammatic view similar to FIG. 2 with parts removed and other parts added.

After loading system with propellant 26, and gun 10 has been aimed, if necessary, switch 82 is closed thereby initially energising the resistance heating element (not shown) of detonator portion 48 so as to cause ignition of propellant 26. As the ignited propellant burns it progressively forms a plasma from the cap end of chamber 24 to the projectile end thereof. As the result of the plasma being formed, the plasma exerts pressure on inner sleeve 16 throughout chamber 24 where such pressure acts on the pair of switches 50 and 52 to simultaneously move plungers 57 of the switches and close same so as to energize solenoid 92 of switch 90. Energization of solenoid 92 closes contact 94 of switch 90. Closing of contact 94 connects lead 74 to power supply 66 where coil 62 is now energized. Energization of coil 62 generates a magnetic field to envelope the plasma in chamber 24 so as to induce eddy currents therein. These currents in turn cause heating of the plasma and thus further pressurizing of same. Further pressurization of the plasma causes projectile 28 to accelerate more rapidly in bore 22 so that the projectile exits from barrel 12 at a greater velocity than heretofore obtainable. Hence, solenoid 90 acts as an interlock to prevent accidental energization of coil 62 prior to plasma generating sufficient pressure to actuate both switches 50 and 52. By virtue of coil 62 being continuously energized as the result of closing switches 50, 52, 82 and 90 as aforedescribed, pressurization of the plasma is sustained so that the projectile exits with a desired increased velocity from barrel 12 despite either any heat loss from sleeves 16 and 18 or the somewhat expanded volume of chamber 24 as the projectile advances through bore 22 during firing of system 10. By reason of heating sleeves 16 and 18 and cap 32 during repeated use of system 10, a cooling system (not shown) may be required such as being mounted in sleeve 16 but spaced from coil 62 when the sleeve is formed. Although not shown in FIGS. 1–3 after the projectile is launched from system 10, power supply 66 includes means not shown for reopening switch 82 thereby deenergizing coil 62 prior to another projectile loading and launching cycle of system 10.

Figure 4:
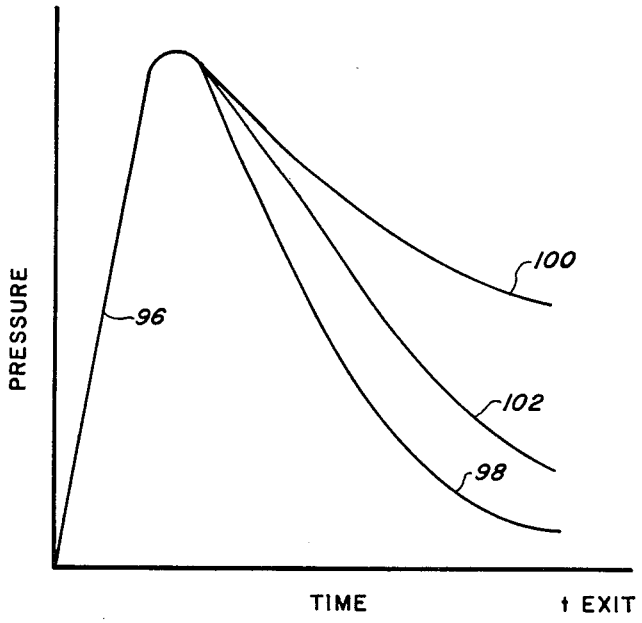
FIG. 4 is a graphical illustration of pressure verse time of a gun-firing system and illustrates pressure performance curves with and without electric augmentation of the ignited propellant.

The pressure in chamber 24 rapidly increases after igniting propellant 26 as illustrated by steep rising curve 96 as indicated in FIG. 4. Once curve 96 has peaked and projectile 28 begins to advance through bore 22, curve 96 rapidly diminishes from its peak as indicated by curved line 98. However, by reason of energized coil 62, curve 96 drops from its peak at a much slower rate as represented by curve 100. By reason of potentiometer 88, the diminishment of curve 100 can be controlled so that further pressurization of the plasma by energized coil 62 is selectively reduced to somewhere between curves 98 and 100 as represented, e.g., by curve 102.

Figure 5:
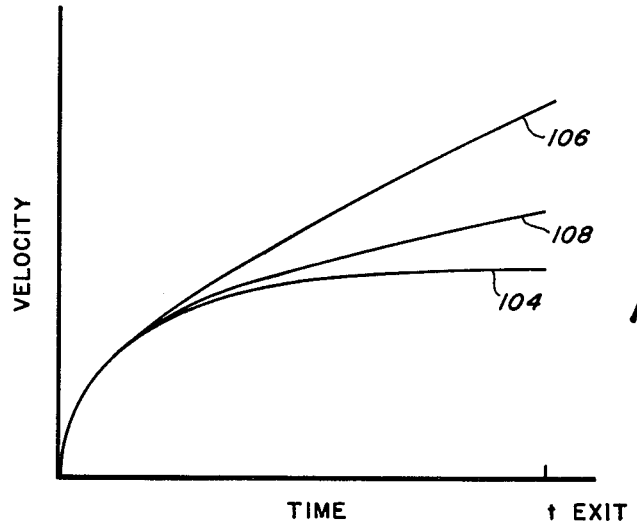
FIG. 5 is a graphical illustration of velocity verse time of a launched projectile and illustrates projectile velocity performance curves of a gun system with and without electric augmentation of the ignited propellant.

As further shown in FIG. 5, the velocity of projectile 28 is significantly increased as the result of the plasma being subjected to energized coil. Without coil 62, the velocity of projectile 28 would be shown by lowermost curve 104. As the result of coil 62, the projectile velocity could be maximized as represented by higher curve 106. And by reason of potentiometer 88, the projectile velocity can be controlled to lie somewhere between curves 104 and 106 as indicated by curve 108.

Figure 6:
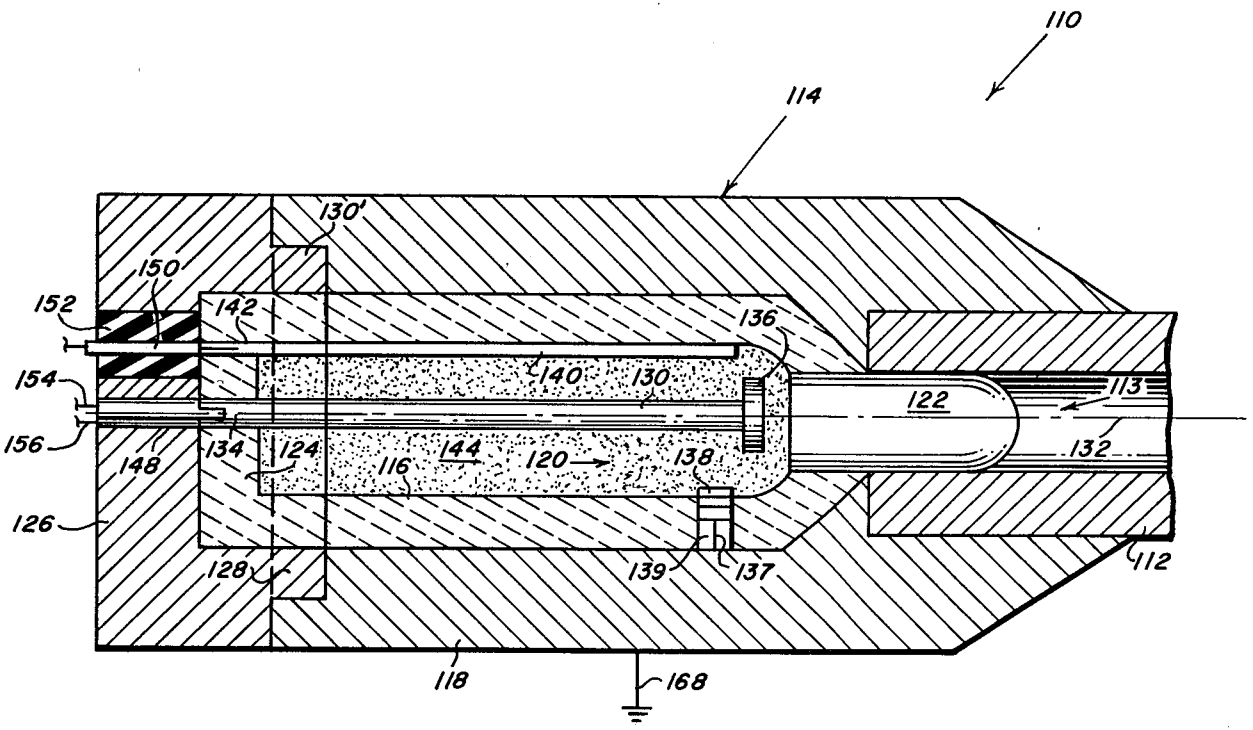
FIG. 6 is a cross-sectional view of another embodiment of the invention with parts removed and other parts broken away.

In another embodiment of a gun-firing system 110 of the invention as shown in FIG. 6, it is generally made up of a barrel 112 having bore 113 and breech 114. The breech is provided with inner and outer sleeves 116 and 118. The inner sleeve includes a chamber 120 which is open at the inner end for receiving a projectile 122 and is closed at its outer end by an integral cover portion 124. A cap 126 is provided to cover the outer end of sleeves 116 and 118 as illustrated in FIG. 6. The cap includes an inner end 128 of stepped or reduced configuration. The outer end of sleeve 118 is provided with a counterbore 130' for receiving the reduced cap end 128 in similar fashion as with cap 32 of the embodiment FIGS. 1–3. Also, cap 126 when it is connected to sleeves 116 and 118 is secured to outer sleeve 118 by a suitable locking device (not shown). Sleeve 116 and cap 126 are each composed of a suitable electric non-conducting and thermal insulating material. Sleeve 118 is preferably composed of a suitable metal material for reinforcing sleeve 116.

A detonator 130 is mounted in sleeve 116 such that the detonator is axially aligned with the common axis 132 of system 110 and extends longitudinally from its outer end 134 in cover portion 124 to its inner enlarged end 136 adjacent projectile 122. Outer end 134 of the detonator is inserted in the coaxial opening of cover portion 124 and suitably affixed to the cover portion. Enlarged end 136 is provided with a suitable electric resistance heating element (not shown).

A pair of electrodes of special and different construction are mounted in sleeve 116 in diametrically opposed and spaced relation to each other in chamber 120. One electrode 138 of the pair is of plug-like configuration and is mounted in a radial opening 139 of sleeve 116 at the inner end thereof as depicted in FIG. 6. Further, electrode 138, to the extent in opening 139, is suitably affixed to sleeve 116. A lead 137 electrically connects electrode 138 to outer sleeve 118. The other electrode 140 of strip-like configuration and elongated construction is arranged along the interior surface of sleeve 116 so as to extend from the covered outer portion 124 of sleeve 116 to adjacent its inner end. Electrode 140 is arranged in chamber 120 so that it is disposed in diametrically opposed and spaced relationship to both detonator 130 and electrode 138. At the same time, the outer end of electrode 140 is arranged in a radial offset opening 142 of sleeve covered portion 124 and affixed thereto so as to positively support electrode 140 in its position in chamber 120 during normal use of system 110 as illustrated in FIG. 6.

By reason of detonator 130 and electrode 140 extending into chamber 120, sleeve 116 is advantageously slidably connected to sleeve 118 such that sleeve 116 is readily inserted in the bore of sleeve 118 or removed therefrom when cap 126 is disconnected from sleeves 116 and 118 as evident from FIG. 6. With sleeve 116 being slidable in the bore of sleeve 118, chamber 120 can be filled with a suitable solid propellant 144 and the inner end of sleeve 116 closed off by projectile 122 before inserting sleeve 116 in the bore of sleeve 118. In other words, sleeve 116 when filled with propellant 144 between the ends of chamber 120 and with the inner end of sleeve 116 closed off by projectile 122, sleeve 116 is in effect a removable and expendable cartridge that can be readily loaded in sleeve 118 and unloaded therefrom during system use. Thus, the cartridge design of sleeve 116 eliminates propellant and projectile handling in using system 110. Similarly, although not shown in system 10 of FIGS. 1–3, sleeve 16 could be of removable construction and cartridge design for facilitating loading and unloading of system 10 during its use.

In order to facilitate connection of a power supply 146 to detonator 130 and electrode 140, electric interconnecting means are provided. To this end, cap 126 includes a concentric rod 148 having a reduced end for insertion into the opening at the outer end of detonator 130 so as to provide electric connection between rod 148 and detonator 130 when cap 126 is connected to sleeves 116 and 118. Similarly, a pin 150 is mounted in a radial offset opening of cap 126 and aligned with and electrically connected to the outer end of electrode 140 when cap 126 is connected to sleeves 116 and 118. Since electrode 140 is subject to a high potential during system use, an electric insulating sleeve 152 is interposed between pin 150 and cap 126 as illustrated in FIG. 6.

Figure 7:
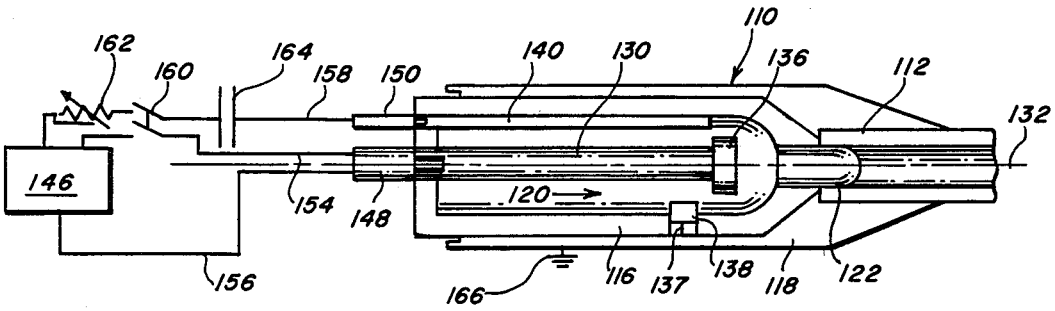
FIG. 7 is a reduced schematic view of the system of FIG. 6 with parts added and other parts broken away and illustrates further details of the invention.

As depicted in FIG. 7, leads 154 and 156 series connect power supply 146 via rod 148 to detonator 130 and to the heating element (not shown) at its enlarged inner end 136. A lead 158 series connects power supply 146 via pin 150 to electrode 140. A normally-open manually-operated switch 160 of double bridge-contact construction is connected to leads 154 and 158. A potentiometer 162 and a capacitance 164 are series connected to lead 158 as depicted in FIG. 7. Outer sleeve 118 is connected to ground 166.

In an operative embodiment of the system of FIGS. 6–7, sleeve 116 with propellant 144 and projectile 122 assembled thereto is inserted in the bore of sleeve 118. Then cap 126 is connected to and secured to both sleeves 116 and 118 prior to the user closing switch 160. Upon switch 160 being closed, the propellant is ignited by the heating element (not shown) at the inner end of detonator 130 thereby progressively transforming the propellant into a plasma from the inner end of chamber 120 to its outer end. The progressively formed plasma in chamber 120 between its ends eventually forms a conductive path between the inner end of electrode 140 and electrode 138. As the result of this path, an arc discharge is formed between electrodes 138 and 140 since electrode 140 is maintained at a high potential by power supply 146 with switch 160 closed during use of system 110. Further, as the plasma progressively forms in chamber 120 towards its outer end, the arc discharge is sustained and continues to expand toward the chamber outer end. Because of the sustained and expanding arc discharge, the plasma is further heated and pressurized in chamber 120 thereby enhancing the propelling and acceleration of projectile 122 as it advances from the inner end of bore 113 and exits from the outer end of the bore at a greater velocity than would be the case without the electric augmentation caused by the arc discharge between the electrodes. Moreover, because of the arc discharge being sustained and expanding during firing of system 110, greater launch velocity of projectile is assured despite heat loss through cap 126, sleeves 116 and 118 and barrel 112; and also despite the expansion of the volume of chamber 120 to include the increasing volume at the inner end of bore 113 as the projectile accelerates out of the bore. By adjustment of potentiometer 162, the performance of system 110 can be tailored to obtain performance pressure and velocity curves 100, 102 and 106, 108 of FIGS. 4–5 as aforedescribed. Also, after projectile 122 is launched, power supply 146 includes means (not shown) for reopening switch 160 thereby disconnecting the high potential from removable cap 126 before another projectile loading cycle of system 110 begins.

Obviously many modifications and variations of the present invention are possible in light of the above teachings. It is therefore to be understood that, within the scope of the appended claims, the invention may be practiced otherwise than as specifically described.

What is claimed is:

1. A gun firing system comprising:

a barrel having a longitudinally extending bore between its ends, breech means connected to the inner end of the barrel, the breech means having a chamber for receiving propellant for accelerating and launching a projectile in the barrel bore at the inner end, the chamber being closed off from open communication with the bore when the projectile is in the bore at the inner end of the barrel, removable cap means connected to the outer end of the breech means for closing off the outer end of the chamber, said cap, means including detonator means for igniting propellant in the chamber, said breech means being comprised of inner and outer sleeve means, the inner sleeve means being made up of insulated and electric nonconducting material that surrounds the chamber and extends between its ends, the outer sleeve means being of electrically nonconductive material, the inner sleeve means including electromagnetic coil means embedded therein such that the coil means extends between the ends of the inner sleeve means while at the same time the coil means is concentrically and helically wound about the axis of the sleeve means, a pair of pressure responsive switch means, first switch means of the pair being connected to the inner and outer sleeve means at the barrel end thereof and being arranged in direct open communication with the chamber at its inner end, second switch means of the pair being connected to the inner and outer sleeve means at the cap means end thereof, said second switch means being arranged in direct open communication with the chamber at its outer end and longitudinally spaced from the first switch means, said pair of switch means being responsive to a plasma pressure formed in the chamber upon detonation of the propellant so as to actuate both switch means of the pair when the pressure of the plasma formed in the chamber substantially extends throughout the chamber, and power supply means operatively associated with and electrically connected to said detonator means, said power supply means being operable for actuating said detonator means to ignite the propellant so as to progressively form a plasma between the ends of the chamber; and the power supply means, in response to the plasma pressure actuating the first and second switch means, being further operable for energizing the coil means to induce eddy currents in the plasma so as to increase the temperature and pressure thereof thereby increasing the velocity of the projectile as it exits from the outer end of the barrel during system use.

2. A system as set forth in claim 1 wherein said detonator means is disposed at the outer end of the chamber so as to progressively ignite the propellant from the outer end of the chamber toward the inner end thereof upon actuation of said detonation means during system use.

3. A system as set forth in claim 1 wherein the breech chamber has a larger diameter than the barrel bore.

4. A system as set forth in claim 1 wherein said power supply means includes potentiometer means for adjusting the intensity of the field generated by the coil means.

5. A system as set forth in claim 1 wherein said power supply means includes separate first, second and third circuit means for said detonation means, said first and second switch means, and said coil means respectively.

6. A system as set forth in claim 5 wherein said power supply means includes a normally open manually-operated switch means; and wherein said switch means is operatively associated with said first, second, and third circuit means.

7. A system as set forth in claim 5 wherein said second and third circuit means includes interlock means for preventing energization of said third circuit means and the coil means thereof until the first and second switch means is actuated.

8. A system as set forth in claim 7 wherein said interlock means is a solenoid-operated and normally-open switch of bridge-contact construction.

9. A gun firing system comprising:

a barrel having a longitudinally extending bore between its ends, the inner end of the bore for receiving a projectile to be accelerated and launched during system use, breech means connected to the inner end of the barrel, the breech means being comprised of inner and outer sleeve means, the inner sleeve means being made up of insulated and electric nonconducting material, the outer end of the inner sleeve means having cover means for closing off same, the inner sleeve means having a propellant-receiving chamber between its ends, the inner end of the inner sleeve means being closed off by a projectile to be launched, the outer sleeve means reinforcing the inner sleeve means and being made up of an electric conducting material that is connected to a ground, cap means of electric nonconducting material connected to the outer ends of both the inner and outer sleeve means, detonation means affixed to said cap means and the cover means and being arranged to longitudinally extend into the chamber so as to be disposed adjacent to but spaced from the projectile, first electrode means connected to the cap means and the cover means and being spaced from said detonation means, the first electrode means being of strip-like construction and arranged to extend into the chamber so as to be disposed adjacent to but spaced from the projectile, second electrode means of plug-like construction connected to the inner end of the inner sleeve means in opposed and spaced relation to the first electrode means, detonation means and the projectile, the second electrode means being electrically connected to the outer sleeve means, and power supply means having switch means and connected to the detonation means and the first electrode means, said power supply means when said switch means is closed for causing operation of the detonation means to ignite the propellant so as to progressively form a plasma between the ends of the chamber while at substantially the same time for also causing operation of both of said electrode means to effect formation of a sustained and expanding electric arc discharge between the electrode means and through the plasma between the ends of the chamber that results in a further increase in the temperature and pressure of the plasma thereby enhancing the velocity of the projectile as it exits from the barrel during system use.

10. A system as in claim 9 wherein the detonation means is arranged to coincide with the longitudinal axis of the breech means.

11. A system as in claim 9 wherein said detonation means and said first electrode means are made up of interconnecting sections for facilitating the disconnection of the cap means from both sleeve means.

12. A system as in claim 9 wherein the inner sleeve means is insertable into the bore of the outer sleeve means so as to facilitate loading of the system upon disconnection of the cap means from both of said sleeve means.

13. A system as in claim 9 wherein said power supply means includes capacitance means connected to the first electrode means when the switch means is closed.

14. A system as set forth in claim 9 wherein said power supply means includes potentiometer means for adjusting the potential of the first electrode means.

15. A system as set forth in claim 9 wherein said breech chamber has a diameter larger than the barrel bore.

* * * * *